US011022252B2

(12) United States Patent
Jansson et al.

(10) Patent No.: US 11,022,252 B2
(45) Date of Patent: Jun. 1, 2021

(54) BILOBE OR MULTILOBE TANK

(71) Applicant: WÄRTSILÄ FINLAND OY, Vaasa (FI)

(72) Inventors: Mathias Jansson, Vaasa (FI); Martin Råholm, Vaasa (FI); Marcin Malys, Gdynia (PL); Maciej Adamowicz, Gdynia (PL); Malgorzata Koczur-Grazawska, Gdynia (PL); Grzegorz Slusarski, Gdynia (PL)

(73) Assignee: WÄRTSILÄ FINLAND OY, Vaasa (FI)

( * ) Notice: Subject to any disclaimer, the term of this patent is extended or adjusted under 35 U.S.C. 154(b) by 0 days.

(21) Appl. No.: 16/185,827

(22) Filed: Nov. 9, 2018

(65) Prior Publication Data

US 2019/0078735 A1 Mar. 14, 2019

Related U.S. Application Data

(63) Continuation of application No. PCT/FI2016/050305, filed on May 10, 2016.

(51) Int. Cl.
*F17C 3/02* (2006.01)
*F17C 3/04* (2006.01)

(52) U.S. Cl.
CPC ..... *F17C 3/025* (2013.01); *F17C 3/04* (2013.01); *F17C 2201/0152* (2013.01);
(Continued)

(58) Field of Classification Search
CPC .... F17C 3/025; F17C 3/04; F17C 2201/0152; F17C 2260/011
(Continued)

(56) References Cited

U.S. PATENT DOCUMENTS 2,341,044 A * 2/1944 Jackson ..... F17C 1/08 220/584
3,004,509 A * 10/1961 Leroux ..... F17C 1/002 114/74 A
(Continued)

FOREIGN PATENT DOCUMENTS

CA 2716895 A1 * 7/2010 ..... F17C 1/08
CN 105626313 A 6/2016
(Continued)

OTHER PUBLICATIONS

Office Action (Rejection) dated Oct. 17, 2019, by the United States Patent and Trademark Office in U.S. Appl. No. 16/185,575. (18 pages).
(Continued)

*Primary Examiner* — Rafael A Ortiz
(74) *Attorney, Agent, or Firm* — Buchanan Ingersoll & Rooney PC

(57) ABSTRACT

An exemplary bilobe or multilobe tank for storing liquefied natural gas includes at least two tank sections, each tank section having a curved upper surface and curved bottom surface, the tank sections being joined to each other so that the tank has an undulating upper surface and an undulating lower surface. Each tank section is connected to an adjacent tank section with at least one connecting duct so that a horizontal flow path is formed between the lowermost points of the adjacent tank sections or between the uppermost points of the adjacent tank sections.

10 Claims, 3 Drawing Sheets

(52) U.S. Cl.
CPC ..... *F17C 2201/0171* (2013.01); *F17C 2201/035* (2013.01); *F17C 2201/054* (2013.01); *F17C 2203/0333* (2013.01); *F17C 2203/0617* (2013.01); *F17C 2203/0643* (2013.01); *F17C 2205/0332* (2013.01); *F17C 2221/033* (2013.01); *F17C 2223/0161* (2013.01); *F17C 2223/033* (2013.01); *F17C 2260/011* (2013.01); *F17C 2260/02* (2013.01); *F17C 2270/0105* (2013.01)

(58) Field of Classification Search
USPC ..... 220/560.11, 560.04, 560.09
See application file for complete search history.

(56) References Cited

U.S. PATENT DOCUMENTS

| | | | | |
|---|---|---|---|---|
| 3,092,063 | A | 6/1963 | Leroux | |
| 3,472,414 | A * | 10/1969 | Rodrigues | F17C 1/002 220/581 |
| 3,640,237 | A | 2/1972 | Phelps | |
| 4,182,254 | A | 1/1980 | Secord | |
| 4,188,157 | A | 2/1980 | Vigander | |
| 4,374,478 | A * | 2/1983 | Secord | F17C 3/022 73/863.31 |
| 4,946,056 | A * | 8/1990 | Stannard | B65D 90/02 220/501 |
| 5,127,230 | A | 7/1992 | Neeser et al. | |
| 6,745,983 | B2 * | 6/2004 | Taylor | F02K 9/60 220/560.11 |
| 8,020,722 | B2 * | 9/2011 | Richards | F17C 1/14 220/4.12 |
| 8,479,938 | B2 * | 7/2013 | Pu | B60P 3/2205 220/1.5 |
| 2004/0211784 | A1 | 10/2004 | Luongo | |
| 2005/0145160 | A1 | 7/2005 | Kellermann et al. | |
| 2006/0222523 | A1 | 10/2006 | Valentian et al. | |
| 2009/0050635 | A1 | 2/2009 | Richards et al. | |
| 2010/0012014 | A1 | 1/2010 | Holland et al. | |
| 2010/0281887 | A1 | 11/2010 | Ha | |
| 2014/0223924 | A1 | 8/2014 | Gustafson et al. | |
| 2016/0084441 | A1 | 3/2016 | Fauvel et al. | |
| 2016/0238193 | A1 | 8/2016 | Meyer | |

FOREIGN PATENT DOCUMENTS

| | | | | |
|---|---|---|---|---|
| EP | 0 977 335 | A1 | 5/2000 | |
| EP | 0997335 | A1 | 5/2000 | |
| EP | 1 447 323 | A1 | 8/2004 | |
| EP | 2 481 968 | A2 | 8/2012 | |
| EP | 2 765 296 | A1 | 8/2014 | |
| EP | 3 056 792 | A2 | 8/2016 | |
| GB | 2 032 506 | A | 5/1980 | |
| GB | 2032506 | A * | 5/1980 | F16C 13/082 |
| KR | 10-2008-0093980 | A | 10/2008 | |
| KR | 20110021463 | A | 3/2011 | |
| WO | 03/016777 | A1 | 2/2003 | |
| WO | 2007/062770 | A2 | 6/2007 | |
| WO | 2010/006023 | A2 | 1/2010 | |
| WO | 2016/057023 | A1 | 4/2016 | |
| WO | WO-2016057023 | A1 * | 4/2016 | F17C 13/002 |

OTHER PUBLICATIONS

Office Action (Final Rejection) dated Apr. 15, 2020, by the U.S. Patent and Trademark Office in corresponding U.S. Appl. No. 16/185,575. (17 pages).

Office Action (Notice of Allowance) dated May 5, 2020, by the U.S. Patent and Trademark Office in corresponding U.S. Appl. No. 16/185,896. (7 pages).

International Search Report (PCT/ISA/210) dated Feb. 13, 2017, by the European Patent Office as the International Searching Authority for International Application No. PCT/FI2016/050304.

International Search Report (PCT/ISA/210) dated Feb. 9, 2017, by the European Patent Office as the International Searching Authority for International Application No. PCT/FI2016/050305.

International Search Report (PCT/ISA/210) dated Feb. 9, 2017, by the European Patent Office as the International Searching Authority for International Application No. PCT/FI2016/050306

Notification of Transmittal of the International Preliminary Report on Patentability (PCT Rule 71.1) (Form PCT/IPEA/416) and International Preliminary Report on Patentability (Chapter II of the Patent Cooperation Treaty)(PCT Article 36 and Rule 70) (Form PCT/IPEA/409) dated Jul. 10, 2018, in the corresponding International Application No. PCT/FI2016/050304

Notification of Transmittal of the International Preliminary Report on Patentability (PCT Rule 71.1) (Form PCT/IPEA/416) and International Preliminary Report on Patentability (Chapter II of the Patent Cooperation Treaty)(PCT Article 36 and Rule 70) (Form PCT/IPEA/409) dated Jul. 10, 2018, in the corresponding International Application No. PCT/FI2016/050305.

Notification of Transmittal of the International Preliminary Report on Patentability (PCT Rule 71.1) (Form PCT/IPEA/416) and International Preliminary Report on Patentability (Chapter II of the Patent Cooperation Treaty)(PCT Article 36 and Rule 70) (Form PCT/IPEA/409) dated Jul. 10, 2018, in the corresponding international Application No. PCT/FI2016/050306.

Written Opinion (PCT/ISA/237) dated Feb. 13, 2017, by the European Patent Office as the International Searching Authority for International Application No. PCT/FI2016/050304.

Written Opinion (PCT/ISA/237) dated Feb. 9, 2017, by the European Patent Office as the International Searching Authority for International Application No. PCT/FI2016/050305.

Written Opinion (PCT/ISA/237) dated Feb. 9, 2017, by the European Patent Office as the International Searching Authority for International Application No. PCT/FI2016/050306.

Office Action (Final Rejection) issued in copending U.S. Appl. No. 16/185,575 dated Dec. 31, 2020, by the U.S. Patent and Trademark Office (23 pages).

Notice of Grounds for Rejection issued by the Korean Intellectual Property Office in corresponding Korean Patent Application No. 10-2018-7032603 dated Mar. 29, 2019 (14 pages including English translation).

Grant of Patent issued by the Korean Intellectual Property Office in corresponding Korean Patent Application No. 10-2018-7032603 dated Jul. 24, 2019 (3 pages including English translation).

* cited by examiner

BILOBE OR MULTILOBE TANK

RELATED APPLICATION

This application claims priority as a continuation application under 35 U.S.C. § 120 to PCT/FI2016/050305, which was filed as an International Application on May 10, 2016, designating the U.S., the entire content of which is hereby incorporated by reference in its entirety.

FIELD

The present disclosure relates to a bilobe or multilobe tank for storing liquefied natural gas.

BACKGROUND INFORMATION

Natural gas, and mixtures of hydrocarbons that are volatile enough to make the mixture appear in gaseous form in room temperature can constitute an advantageous alternative to fuel oil as the fuel of internal combustion engines. In sea-going vessels that use natural gas as fuel, the natural gas can be stored onboard in liquid form, giving rise to the commonly used acronym LNG (Liquefied Natural Gas). Natural gas can be kept in liquid form by maintaining its temperature below a boiling point, which is approximately −162 degrees centigrade. LNG can be stored at a pressure that is close to the atmospheric pressure, but large tanks used for storing LNG need to withstand significant hydrostatic pressures and a certain overpressure. For achieving good mechanical strength, LNG tanks can be constructed as cylindrical or spherical containers. However, for practical reasons, large LNG tanks are sometimes designed as bilobe or multilobe tanks instead of cylindrical tanks. A bilobe tank includes two mating curved halves, for instance two spherical caps or two cylindrical segments. A multilobe tank includes at least three curved sections that are joined to each other. The sections can be partial cylinders or spheres.

An LNG tank having a shape of a horizontal cylinder has a bottom level running along a line in the bottom of the cylinder. Similarly, it has a top level running along a line in the top of the cylinder. An outlet for discharging liquefied gas can be located anywhere along the bottom level and a pressure relieve valve can be located anywhere along the top level. Since a multilobe tank can include several parallel cylindrical or spherical segments, the bottom level is not defined by a single line but by several lines separated from each other by raised sections. Similarly, the top level is defined by several lines separated from each other by lowered sections. For enabling complete emptying of a multilobe tank, several outlets are used. For safety reasons, it can be important that all spaces that hold fluid in gas phase are directly connected to a pressure relief valve. Otherwise, overpressure may spill fluid that is in liquid phase out of the tank. This limits the maximum liquid level in a multilobe tank.

SUMMARY

A bilobe or multilobe tank is disclosed for storing liquefied natural gas, the tank comprising: at least two tank sections, each tank section having a curved upper surface and curved bottom surface, the tank sections being joined to each other so that the tank has an undulating upper surface and an undulating lower surface; and an adjacent tank section connected to each tank section, with at least one connecting duct so that a horizontal flow path is formed between lowermost points of the adjacent tank sections with lower edges of the connecting ducts being in a vertical direction, at a same level as lowermost points of the tank sections, or between uppermost points of the adjacent tank sections so that upper edges of the at least one connecting duct are, in a vertical direction, at a same level as the uppermost points of the tank sections, wherein the at least one connecting duct is a bulge, which is perpendicular to a longitudinal axis of the tank, joins to walls of the tank outside the tank, and is joined to the tank by a welded joint.

BRIEF DESCRIPTION OF THE DRAWINGS

Other features and advantages of the present disclosure will be appreciated from exemplary embodiments as disclosed herein with reference to the accompanying drawings, in which.

DETAILED DESCRIPTION

An improved bilobe or multilobe tank for storing liquefied natural gas is disclosed.

An exemplary tank according to the present disclosure includes at least two tank sections, each tank section having a curved upper surface and curved bottom surface, the tank sections being joined to each other so that the tank has an undulating upper surface and an undulating lower surface. Each tank section is connected to an adjacent tank section with at least one horizontal connecting duct so that a horizontal flow path is formed between the lowermost points of the adjacent tank sections or between the uppermost points of the adjacent tank sections.

By connecting the lowermost points of the tank sections, a single outlet is sufficient for emptying a bilobe or multilobe tank. By connecting the uppermost points of the tank sections, gas flow between the tank sections is allowed regardless of the liquid level inside the tank, which increases safety.

According to an exemplary embodiment of the disclosure, the tank can include at least one lower connecting duct for connecting the lowermost points of two adjacent tank sections and at least one upper connecting duct for connecting the uppermost points of two adjacent tank sections.

According to an exemplary embodiment of the disclosure, the connecting ducts are bulges, which are perpendicular to the longitudinal axis of the tank and join to the walls of the tank outside the tank.

According to an exemplary embodiment of the disclosure, each tank section has a shape of a segment of a horizontal cylinder.

According to an exemplary embodiment of the disclosure, an inlet for a pressure relief valve is arranged at an uppermost point of the tank.

According to an exemplary embodiment of the disclosure, the tank is provided with an outlet that is arranged at the lowermost point of the tank.

An exemplary sea-going vessel according to the disclosure includes a bilobe or multilobe tank defined above.

Figure 1:
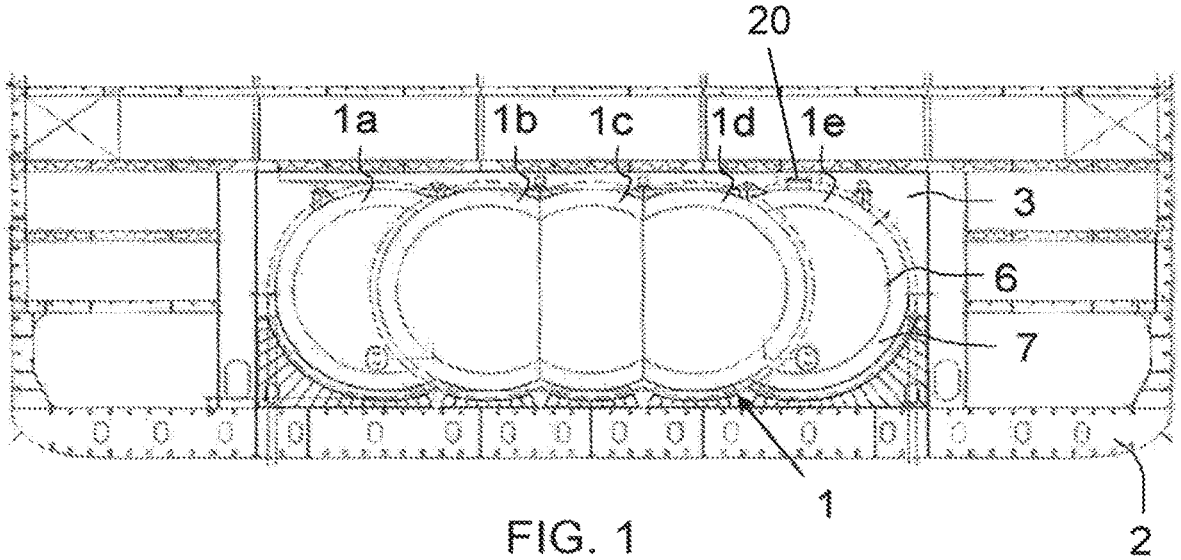
FIG. 1 shows a cross-sectional view of a ship having an exemplary LNG tank arrangement.
Figure 2:
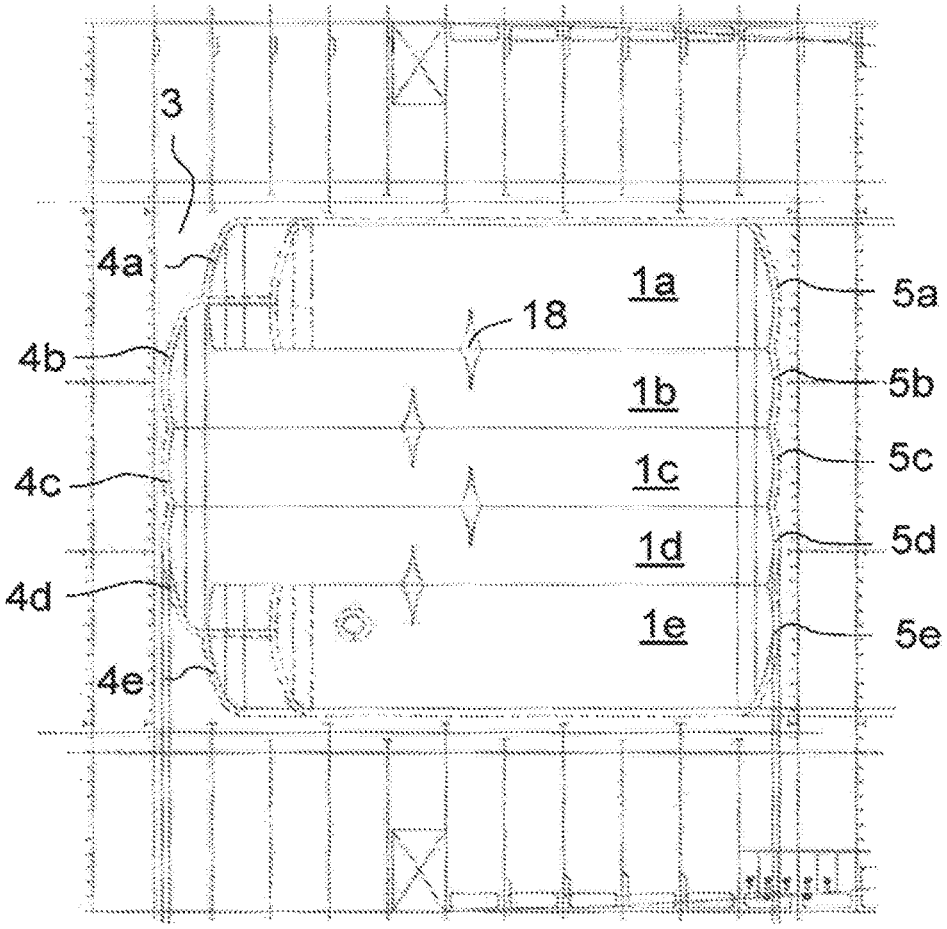
FIG. 2 shows a top view of the tank arrangement of FIG. 1.
Figure 3:
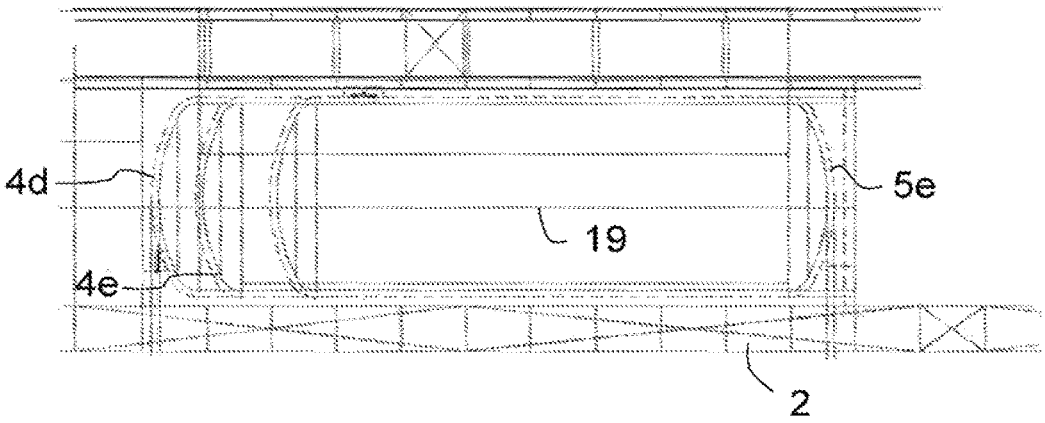
FIG. 3 shows a side view of the tank arrangement.

FIGS. 1 to 3 show an exemplary LNG tank arrangement of a ship 2. The arrangement includes an LNG tank 1. The LNG tank 1 is a container that is configured to store liquefied natural gas. Natural gas is kept in liquid form by maintaining its temperature below a boiling point, which is approximately −162 degrees centigrade. The LNG tank 1 is located in a tank hold 3, which is located around the longitudinal center line of the ship 2. The LNG tank 1 stores liquefied gas that is used as fuel in one or more engines of the ship 2.

The LNG tank 1 can have a single shell structure. The space holding the LNG is formed by a shell 6 that is made of a cold resistant material. The expression "cold resistant material" refers to a material that can withstand the temperature of liquefied natural gas. Minimum design temperature of the material should be at most −165° C. The material can be, for instance, stainless steel. Suitable materials are, for instance, 9% nickel steel, low manganese steel, austenitic steels, such as types 304, 304L, 316, 316L, 321 and 347 and austenitic Fe—Ni alloy (36% nickel). An insulation layer 7 is arranged around the shell 6. The insulation layer 7 can be made of, for instance, polyurethane.

The LNG tank 1 can be a multilobe tank. The expression "multilobe tank" refers here to a tank that includes at least three tank sections that have a curved cross-sectional profile and which are joined to each other such that the shell 6 of the tank 1 has an undulating shape at least on two sides. In the exemplary embodiment illustrated in the figures, the LNG tank 1 includes five tank sections 1*a*, 1*b*, 1*c*, 1*d*, 1*e* each having the shape of a partial cylinder. The longitudinal center lines of the exemplary tank sections 1*a*, 1*b*, 1*c*, 1*d*, 1*e* are parallel to each other. The centermost tank section 1*c* has a shape that is formed by cutting a segment from a horizontal cylinder by two vertical planes. The other tank sections 1*a*, 1*b*, 1*d*, 1*e* can each have a shape that is formed by cutting a segment from a horizontal cylinder by one vertical plane. The exemplary sections 1*a*, 1*b*, 1*c*, 1*d*, 1*e* of the tank 1 are arranged in a row in a horizontal plane. The outermost tank sections 1*a*, 1*e* are shorter than the three sections 1*b*, 1*c*, 1*d* in the middle of the LNG tank 1. The ends of the tank sections 1*a*, 1*b*, 1*c*, 1*d*, 1*e* are closed by end caps 4*a*, 4*b*, 4*c*, 4*d*, 4*e*, 5*a*, 5*b*, 5*c*, 5*d*, 5*e*. The end caps can have a shape of a spherical cap or part of a spherical cap.

Figure 4:
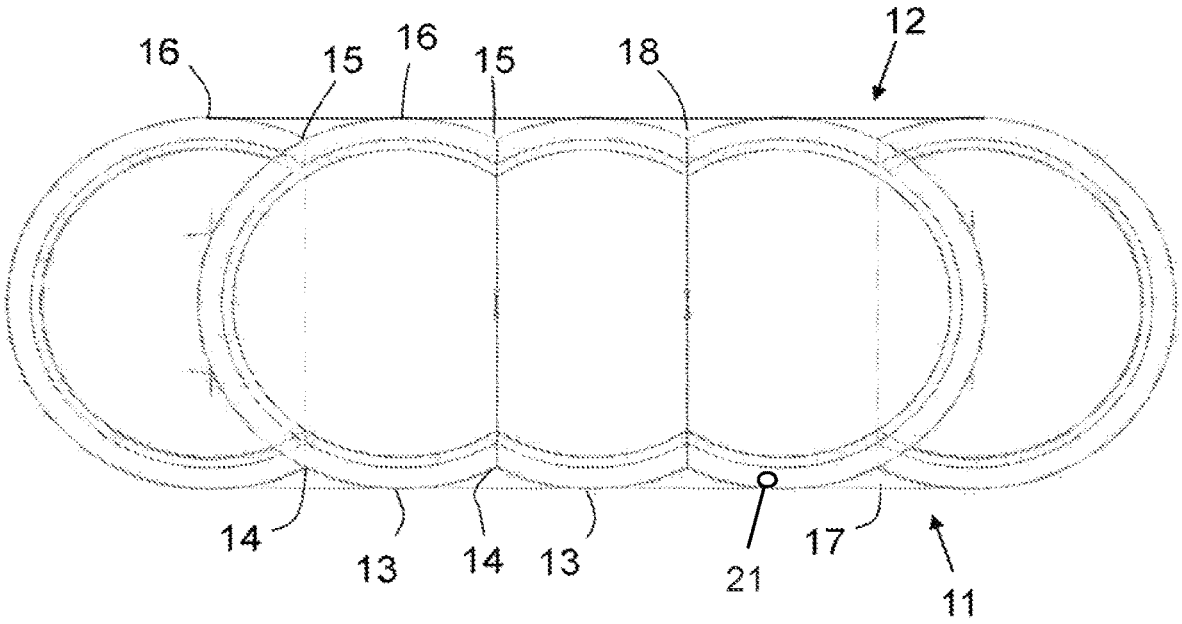
FIG. 4 shows an end view of a multilobe tank according to an exemplary embodiment as disclosed herein.
Figure 5:
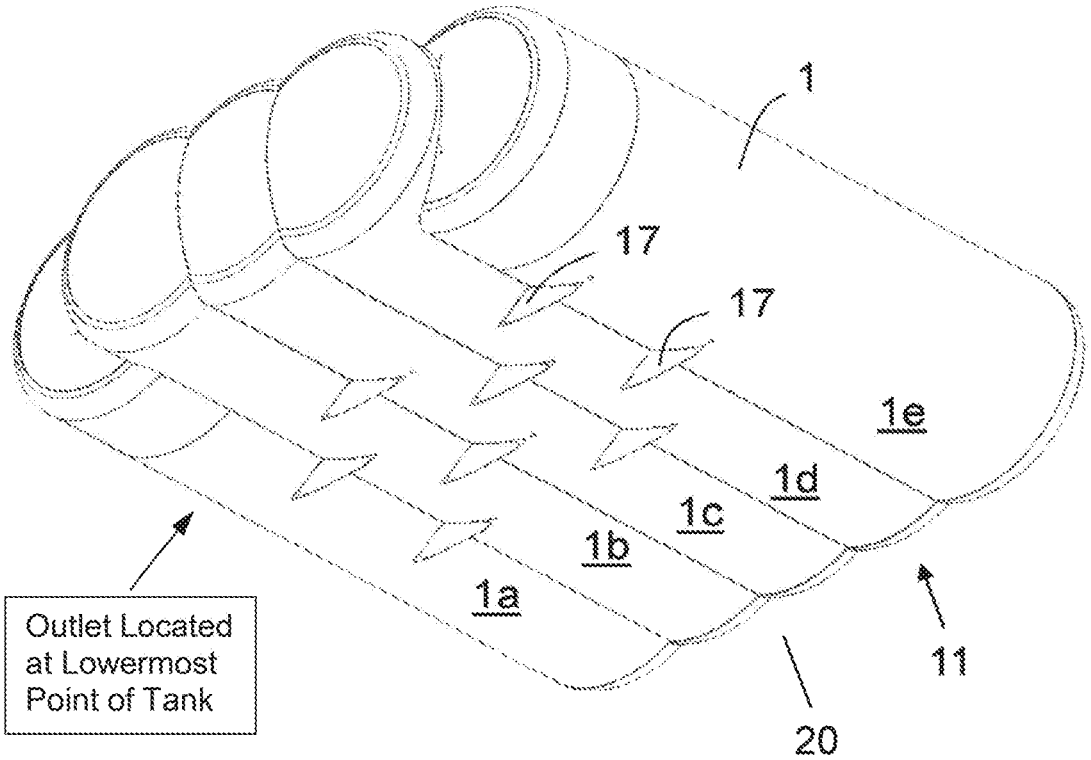
FIG. 5 shows a perspective view of the multilobe tank of FIG. 4.

FIGS. 4 and 5 show a multilobe tank 1 according to an exemplary embodiment of the disclosure. The tank 1 can be used in the tank arrangement of FIGS. 1 to 3. In FIGS. 4 and 5, the tank 1 is shown without the insulation. The tank 1 is configured to be arranged in a horizontal position. The tank 1 has a bottom 11 and top 12. When in use, the top 12 faces upwards and the bottom 11 faces downwards. Since the exemplary tank sections 1*a*, 1*b*, 1*c*, 1*d*, 1*e* forming the tank 1 are segments of horizontal cylinders, both the bottom surface and the top surface has an undulating shape. Each of the surfaces thus has a cross-sectional shape of a wave, where troughs 13, 15 and crests 14, 16 alternate. Inside the tank 1, the uppermost points of tank 1 are located at the areas of the crests 16 of the tops 12 and the lowermost points are located at the areas of the troughs 13 of the bottom 11. Between the troughs 13 of the bottom 11 there are raised sections. Between the crests 16 of the top 12 there are lowered sections. When the liquid level inside the tank 1 is below the crests 14 of the bottom, direct flow of liquid between the tank sections 1*a*, 1*b*, 1*c*, 1*d*, 1*e* is not allowed. If the liquid level inside the tank 1 is above the troughs 15 of the top 12, direct gas flow between the between the tank sections 1*a*, 1*b*, 1*c*, 1*d*, 1*e* is not allowed. For allowing flow between the tank sections 1*a*, 1*b*, 1*c*, 1*d*, 1*e* with all liquid levels, the tank 1 has been provided with horizontal connecting ducts 17, 18. The upper part of the tank 1 includes upper connecting ducts 18 and the lower part of the tank comprises lower connecting ducts 17.

Each exemplary tank section 1*a*, 1*b*, 1*c*, 1*d*, 1*e* is connected to an adjacent tank section with at least one upper connecting duct 18. The upper connecting duct 18 is configured to form a horizontal flow path between the uppermost points of the adjacent tank sections 1*a*, 1*b*, 1*c*, 1*d*, 1*e*. This ensures that gas flow between the exemplary tank sections 1*a*, 1*b*, 1*c*, 1*d*, 1*e* is allowed regardless of the liquid level in the tank 1. In the exemplary embodiment illustrated in the figures, each tank section 1*a*, 1*b*, 1*c*, 1*d*, 1*e* is connected to the adjacent tank sections on both sides with upper connecting ducts 18. An inlet 20 for a pressure relief valve can be arranged at an uppermost point of any of the tank sections 1*a*, 1*b*, 1*c*, 1*d*, 1*e*. The tank 1 can be provided with a pressure relief valve comprising an inlet pipe, and the pressure relief valve does thus not need to be located at an uppermost point of the tank 1, but it is sufficient that the inlet pipe opens to the uppermost point and allows gas flow to the pressure relief valve.

Each exemplary tank section 1*a*, 1*b*, 1*c*, 1*d*, 1*e* is also connected to an adjacent tank section with at least one lower connecting duct 17. The lower connecting duct 17 is configured to form a horizontal flow path between the lowermost points of the adjacent tank sections 1*a*, 1*b*, 1*c*, 1*d*, 1*e*. This can ensure that liquid flow between the tank sections 1*a*, 1*b*, 1*c*, 1*d*, 1*e* is allowed regardless of the liquid level in the tank 1. In the exemplary embodiment illustrated in the figures, each tank section 1*a*, 1*b*, 1*c*, 1*d*, 1*e* is connected to the adjacent tank sections on both sides with lower connecting ducts 17. An outlet 21 for discharging LNG from the tank 1 can be arranged at a lowermost point of any of the tank sections 1*a*, 1*b*, 1*c*, 1*d*, 1*e*.

In the exemplary embodiment illustrated in the Figures, the upper and lower connecting ducts 17, 18 are bulges, which are perpendicular to the longitudinal axis 19 of the tank 1. The bulges join to the walls of the tank 1 outside the tank 1. The connecting ducts 17, 18 are joined to the tank 1 by welding. On the upper surface of the tank 1, the upper edges of the upper connecting ducts 18 are in the vertical direction at the same level as the uppermost points of the tank sections 1*a*, 1*b*, 1*c*, 1*d*, 1*e*. On the lower surface of the tank 1, the lower edges of the lower connecting ducts 17 are in the vertical direction at the same level as the lowermost points of the tank sections 1*a*, 1*b*, 1*c*, 1*d*, 1*e*.

As shown in FIG. 5, each tank section 1*a*, 1*b*, 1*c*, 1*d*, 1*e* can be connected to an adjacent tank section with more than one lower connecting duct 17. In FIG. 5, each tank section 1*a*, 1*b*, 1*c*, 1*d*, 1*e* is connected to the adjacent tank section on the left with two lower connecting ducts 17 and to the tank section on the right with two lower connecting ducts 17. Consecutive connecting ducts 17 are arranged at a distance from each other in the direction of the longitudinal axis 19 of the tank 1. The upper connecting ducts 18 can be arranged in the same way as the lower connecting ducts 17 in FIG. 5.

It will be appreciated by a person skilled in the art that the invention is not limited to the embodiments described above, but may vary within the scope of the appended claims. For instance, instead of being a multilobe tank, the LNG tank could be a bilobe tank having only two sections.

Thus, It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A bilobe or multilobe tank for storing liquefied natural gas, the tank comprising:

at least two tank sections, each tank section having a curved upper surface and curved bottom surface, the tank sections being joined to each other so that the tank has an undulating upper surface and an undulating lower surface; and at least one connecting duct arranged between adjacent tank sections of the at least two tank sections so that a horizontal flow path for the natural gas is formed between lowermost points of the adjacent tank sections with lower edges of a wall of the at least one connecting duct being in a vertical direction, at a same level as lowermost points of the tank sections, or the at least one connecting duct is arranged between uppermost points of the adjacent tank sections so that upper edges of the wall of the at least one connecting duct are, in a vertical direction, at a same level as the uppermost points of the tank sections, wherein the wall of the at least one connecting duct is a bulge, which is perpendicular to a longitudinal axis of the tank, joins to walls of the tank outside the tank, and is joined to the tank by a welded joint.

2. The tank according to claim 1, wherein the tank comprises:

at least one lower connecting duct for connecting the lowermost points of two adjacent tank sections; and at least one upper connecting duct for connecting the uppermost points of two adjacent tank sections.

3. The tank according to claim 1, wherein each tank section has a shape of a segment of a horizontal cylinder.

4. The tank according to claim 1, comprising:

an inlet for a pressure relief valve arranged at an uppermost point of the tank.

5. The tank according to claim 1, comprising:

an outlet arranged at the lowermost point of the tank.

6. The tank according to claim 1, in combination with a sea-going vessel, the combination comprising:

a vessel hull containing the bilobe or multilobe tank.

7. The tank according to claim 2, wherein each tank section has a shape of a segment of a horizontal cylinder.

8. The tank according to claim 7, comprising:

an inlet for a pressure relief valve arranged at an uppermost point of the tank.

9. The tank according to claim 8 comprising:

an outlet arranged at the lowermost point of the tank.

10. The tank according to claim 9, in combination with a sea-going vessel, the combination comprising:

a vessel hull containing the bilobe or multilobe tank.

* * * * *